US008123908B2

(12) United States Patent
Milosavljevic

(10) Patent No.: US 8,123,908 B2
(45) **Date of Patent: *Feb. 28, 2012**

(54) RUNNABILITY COMPONENT AND A METHOD FOR CONTROLLING UNDERPRESSURE IN A DRYING SECTION OF A PAPER MACHINE OR THE LIKE

(75) Inventor: Nenad Milosavljevic, Turku (FI)

(73) Assignee: Metso Paper, Inc., Helsinki (FI)

( * ) Notice: Subject to any disclaimer, the term of this patent is extended or adjusted under 35 U.S.C. 154(b) by 13 days.

This patent is subject to a terminal disclaimer.

(21) Appl. No.: 12/810,427

(22) PCT Filed: Dec. 31, 2008

(86) PCT No.: PCT/FI2008/000149

§ 371 (c)(1),
(2), (4) Date: Jun. 24, 2010

(87) PCT Pub. No.: WO2009/083637

PCT Pub. Date: Jul. 9, 2009

(65) Prior Publication Data

US 2010/0276097 A1 Nov. 4, 2010

(30) Foreign Application Priority Data

Dec. 31, 2007 (FI) ..... 20071031
Dec. 31, 2007 (FI) ..... 20071033

(51) Int. Cl.
*D21F 3/02* (2006.01)

(52) U.S. Cl. ..... 162/205; 162/289; 162/358.1; 34/114

(58) Field of Classification Search ..... 162/205, 162/289, 358.1; 34/114, 115, 116, 123
See application file for complete search history.

(56) References Cited

U.S. PATENT DOCUMENTS

| | | | |
|---|---|---|---|
| 6,574,884 | B1 | 6/2003 | Jokinen |
| 7,422,662 | B2 | 9/2008 | Leimu et al. |
| 2005/0075229 | A1 | 4/2005 | Kurki et al. |

FOREIGN PATENT DOCUMENTS

| | | |
|---|---|---|
| EP | 1 717 367 A | 11/2006 |
| FI | 110625 | 8/2000 |
| FI | 110442 | 1/2003 |
| FI | 115232 | 6/2004 |

OTHER PUBLICATIONS

Search Report (dated Nov. 17, 2008) from Finland Patent Office in priority Application No. FI 20071033.

*Primary Examiner* — Mark Halpern
(74) *Attorney, Agent, or Firm* — Cozen O'Connor

(57) ABSTRACT

The object of the invention is an arrangement and a method for controlling underpressure in the drying section of a paper machine or the like in connection with a pocket space between two drying cylinders and one turn roll. The object of the invention is also a runnability component in a paper machine or the like, such as a board or a finishing machine. The runnability component comprises an entry side, a lower part and an exit side, which are in contact with each other and delimit the volume of a box-like runnability component, and a sealing element, which is arranged in connection with the entry side surface and which divides the surface into a first part and a second part. The runnability component is provided with a channel, which extends from the first part of the entry side surface to its second part and connects them.

22 Claims, 4 Drawing Sheets

RUNNABILITY COMPONENT AND A METHOD FOR CONTROLLING UNDERPRESSURE IN A DRYING SECTION OF A PAPER MACHINE OR THE LIKE

PRIORITY CLAIM

This is a national stage of PCT application No. PCT/FI2008/000149, filed on Dec. 31, 2008. Priority is claimed on patent application No. 20071031 filed in Finland on Dec. 31, 2007, and on patent application No. 20071033 filed in Finland on Dec. 31, 2007.

TECHNICAL FIELD RELATING TO THE INVENTION

The object of the invention is an arrangement and a method for controlling underpressure and for saving energy in a drying section of a paper machine or the like according to the preambles of the independent claims presented below.

PRIOR ART

In a typical drying section of a paper machine or a board machine the web to be dried is conveyed supported by one or two wires in contact with hot drying cylinders. A disadvantage has been the tendency of the web to detach, at certain points, from the contact with the drying wire thereby causing runnability problems. Problematic points are especially

- so-called opening nips, i.e. points where the web and the wire disengage from the drying cylinder. Up to that point, the web has travelled between the wire and the cylinder, and when the wire detaches from the cylinder, the web tends to follow the cylinder surface and thereby to disengage from the wire; and
- so-called closing nips, where the web and the wire are brought into contact with the cylinder. At that point, the web tends to disengage from the wire due to an overpressure formed in the nip.

Opening and closing nips exist both at the drying cylinders and in connection with the turn rolls located between the drying cylinders.

It is previously known to use different kinds of runnability components, such as blow or suction boxes and turning suction rolls in order to create underpressure in the pocket space between the drying cylinders. The underpressure promotes keeping of the web in contact with the wire and thereby improves the runnability of a paper machine. However, creating underpressure by means of runnability components usually consumes a considerable amount of energy. Due to this, the aim is to form more underpressure zones in the pocket space with which the prevailing underpressures can be arranged to be different from each other. Controlling of the underpressures of these underpressure zones is, however, difficult and complicated.

Patent FI 110442 discloses an impingement unit of a paper machine aiming at a controlled curling of the paper and a good runnability, but the publication does not disclose solutions for saving energy.

OBJECT AND DESCRIPTION OF THE INVENTION

The object of this invention is to reduce or even completely eliminate problems existing in prior art.

An object of this invention is to promote the control of the underpressure zones of the pocket space and possibly, at the same time, to reduce energy consumption in the drying section of a paper machine or the like, especially when creating underpressure in the pocket space between two drying cylinders and one turn roll or turning suction roll.

Another object of this invention is to enable the use of a lower underpressure in the turning suction roll or a freer choice of the roll type as a turn roll without impairing the runnability of the paper machine or the like.

The object of this invention is to promote keeping of the web in contact with the wire in connection with the opening nip of the first drying cylinder and in connection with the closing nip of the second drying cylinder.

A further object of this invention is to enable a more economical roll structure with its auxiliary means to serve as a turn roll, preferably without sucking arrangements.

In order to realise, among other things, the above-mentioned objects, the arrangement and the method according to the invention are characterized by what is presented in the characterizing parts of the enclosed independent claims.

The embodiments mentioned in this text relate, where applicable, to both the runnability component, the arrangement and the method according to the invention, even if this is not always separately mentioned.

A typical runnability component according to the invention in a paper machine or the like, such as a board machine or a finishing machine, comprises

- an entry side, a lower part and an exit side, which are in contact with each other and delimit the volume of a box-like runnability component,
- a sealing element, which is arranged in connection with the surface of the entry side and which divides the surface into a first part and a second part, whereby the runnability component is provided with a channel, which extends from the first part of the entry side surface to its second part and connects them.

A typical according to the invention for controlling an underpressure in the drying section of a paper machine or the like in connection with a pocket space between two drying cylinders and one turn roll comprises the following delimiting said pocket space

- a first drying cylinder,
- a second drying cylinder located after the first drying cylinder in the longitudinal direction of the machine,
- a turn roll arranged to be located in a horizontal direction between said drying cylinders in the longitudinal direction of the machine, however lower in the vertical direction than said cylinders, and
- a wire, which is arranged to travel from the peripheral surface of the first drying cylinder to the peripheral surface of the second drying cylinder travelling via the peripheral surface of the turn roll, the arrangement further comprising a box-like runnability component, which is

- elongated in the cross direction of the paper machine or the like,
- arranged to extend substantially over the entire width of the web run,
- at least mainly arranged in said pocket space, and which runnability component comprises

- an entry side, a lower part and an exit side,
- a sealing element directed towards the wire at the first drying cylinder, which sealing element divides the entry side surface of the runnability component into a first part and a second part, whereby the runnability component is provided with at least one channel, which extends from the first part of the entry side surface of the runnability component to its second part, and along which air can be allowed to transfer between the parts.

It has now been surprisingly found out that the underpressure of the pocket space in the drying section of a paper machine or the like can be controlled much more precisely than before by arranging a channel on the entry side of the runnability component, by means of which channel the underpressure zones of the pocket space separated by the sealing element are connected. By means of the channel, the air flows between the underpressure zones of the pocket space can be controlled, when required, and thereby the underpressures of the different underpressure zones and the pressure differences between them can be regulated more precisely. At the same time, the operation of the turn roll is considerably intensified and the control of the web is improved with a low energy consumption, as a channel according to the invention suitable for guiding air is arranged in the front part of the runnability component, i.e. on the entry side, in connection with the gap between the runnability component and the wire, in connection with the sealing element.

According to an embodiment of the invention a channel (by-pass) is arranged in the runnability component, between the first and the second underpressure zone, along which channel the air can be allowed to transfer between the underpressure zones and with which it is thereby possible to control the underpressures of the underpressure zones by adjusting the flow, for example to balance the pressure difference in a desired manner. The by-pass channel is thereby a controlled active leak channel between said underpressure zones. According to this embodiment, the arrangement comprises a second underpressure zone in a part of the pocket space located above the sealing element, which second underpressure zone is delimited, in addition to the sealing element, by the first drying cylinder and the entry side of the runnability component, and means for creating underpressure in the second underpressure zone so that in the second underpressure zone a higher underpressure can be created than in the first underpressure zone.

According to a preferred embodiment of the invention the arrangement for controlling the underpressure in the drying section of a paper machine or the like in connection with a pocket space between two drying cylinders and one turn roll comprises the following delimiting said pocket space a first drying cylinder, a second drying cylinder located after the first drying cylinder in the longitudinal direction of the machine, a turn roll arranged to be located in a horizontal direction between said drying cylinders in the longitudinal direction of the machine, however lower in the vertical direction than said cylinders, and a wire, which is arranged to travel from the first drying cylinder to the turn roll, and from there further on to the second drying cylinder, and which, together with the web supported by it, forms a web run, where the web can be guided in between the wire and the drying cylinders as well as to the outer surface of the wire on the periphery of the turning suction roll, and which arrangement further comprises a box-like runnability component, which is elongated in the cross direction of the paper machine or the like and extends substantially over the entire width of the web run and is at least mainly arranged in said pocket space, and which runnability component is provided with an entry side, a lower part and an exit side, and on the entry side the runnability component has an entry side blow nozzle in connection with a gap between the runnability component and the first drying cylinder in order to blow air substantially against the travelling direction of the web run, away from the pocket space, and which arrangement further comprises a first underpressure zone, which is delimited by the first drying cylinder, the turn roll, the second drying cylinder and the wire travelling via them, the runnability component and the sealing element directed towards the wire at the first drying cylinder, a second underpressure zone in a part of the pocket space located above the sealing element, which second underpressure zone is delimited, in addition to the sealing element, by the first drying cylinder and the entry side of the runnability component, and means for creating underpressure in the second underpressure zone so that in the second underpressure zone a higher underpressure can be created than in the first underpressure zone, whereby at least one channel is arranged in the runnability component, between the first and the second underpressure zones, along which channel air can be allowed to transfer between the underpressure zones.

According to a preferred embodiment of the invention, a channel suitable for guiding air can thus be arranged in connection with the sealing element, in the front part of the runnability component, i.e. on the entry side, in connection with the gap between the runnability component and the wire. By means of this channel it is possible to control and to adjust the flow and the pressure of the air, i.e. the pressure difference between at least two different underpressure zones. This channel is preferably elongated in the cross direction of the paper machine or the like and extends substantially over the entire width of the web run.

In this application, a higher underpressure means a lower absolute pressure. Respectively, a lower underpressure means a higher absolute pressure. An underpressure means a pressure, which is lower than the normal atmospheric pressure (1 bar i.e. 100 kPa).

In a typical paper machine both the runnability components, the drying cylinders and the turn rolls are elongated in the cross direction of the paper machine or the like. Therefore the pocket space defined by them is also elongated in the cross direction of the machine.

The entry side of the runnability component means that part or surface of the runnability component, preferably the half, which is on the side of the first drying cylinder in the longitudinal direction of the paper machine or the like. Respectively, the exit side of the runnability component means that part or surface of the box-like runnability component, preferably the half, which is on the side of the second drying cylinder in the longitudinal direction of the paper machine or the like. The lower part of the runnability component means, in turn, that part or surface of the runnability component, which is located nearest to the turn roll, and which lower part comprises a lower surface arranged substantially towards the turn roll.

The runnability component is preferably a blow box or the like. The runnability component typically comprises one or more blow nozzles or blow slots, such that the air blows ejected from them can be used for drying and/or controlling the moving web travelling beside it.

In the arrangement according to the invention, the second drying cylinder is normally arranged, in the machine direction, after the first drying cylinder such that the longitudinal axes of the first and the second drying cylinders are substantially parallel and are located horizontally on the same level. A typical drying section of a paper machine or the like comprises a number of such parallel drying cylinders located on the same level. The turn roll is arranged between two adjacent drying cylinders so that the longitudinal axis of the roll is substantially parallel with the longitudinal axes of the drying cylinders, but it is located on a lower level in the vertical direction than the drying cylinders. The turn roll is placed between the drying cylinders so that its surface does not touch the surfaces of the drying cylinders.

It is to be noted that the ends of the pocket spaces are typically sealed, for example by means of end plates according to prior art, such as gap plates. The end plates are arranged, in a vertical plane according to machine direction, on both sides on the sides of the machine, and the drying cylinders, the turn roll, the wire and the web run are delimited in the space between them.

In this application, the exit side and the entry side of the pocket space have the following meaning: The pocket space can be divided, in the horizontal longitudinal direction of the machine, at the midpoint of the pocket space, into an entry side and an exit side by an imaginary vertical level having the width of the web run. On the entry side, i.e. between the first drying cylinder and the turning suction roll, and on the exit side, i.e. between the turning suction roll and the second drying cylinder, the pocket space is delimited by the wire, and therefore, during the run, also by the web path formed by the wire and the web.

In this application, the first underpressure zone is a space, which is delimited by the first drying cylinder, the turn roll, the second drying cylinder and the wire travelling via them, the runnability component and the sealing element directed towards the wire and towards the web run supported by the wire at the first drying cylinder.

According to an embodiment of the invention, the underpressure can be created in the first underpressure zone by means of an underpressure prevailing inside the turn roll, which underpressure can be made to effect on the first underpressure zone via openings provided on the entire periphery of the roll. If the turn roll is a roll, which does not suck air in it, then the underpressure can be created for example by connecting the underpressure zone to an underpressure channel. Such an underpressure channel can run for example inside the runnability component from which a connection is then arranged to the first underpressure zone, for example an aperture formed in the lower surface of the runnability component. The underpressure can also be arranged by connecting the underpressure zone by means of a connection to another underpressure zone maintained in the pocket space or in its vicinity.

In this application, the second underpressure zone is a space in the part of the pocket space located above the sealing element, which second underpressure zone is delimited, in addition to the second sealing element, by the first drying cylinder and the entry side of the runnability component. The underpressure is created mainly by an air blow directed towards the web path, away from the pocket space.

According to an embodiment of the invention, an auxiliary sealing element is arranged in the lower part of the runnability component, preferably in its lower surface. The auxiliary sealing element is arranged in the gap between the runnability component and the turning suction roll, in order to seal said gap and thereby to intensify the operation the turning suction roll. The auxiliary sealing element guides the air flow moving along the exit side surface of the turn roll, in the rotational direction of the roll, away from the contact with the surface of the turning suction roll. It also serves as a concrete physical obstacle for the entry of air into the space between the runnability component and the turn roll. Thus, as small of an amount of air as possible enters into the first underpressure zone from between the auxiliary sealing element and the turning suction roll, i.e. in between the runnability component and the turning suction roll. Due to what has been described above, a sufficient underpressure can be created in the first underpressure zone by means of a considerably lower underpressure of the turning suction roll than before.

According to an embodiment of the invention, the auxiliary sealing element is a sealing strip or a multi-stepped sealing strip, for example a labyrinth sealing. In this manner, the exit side blow commonly used in prior art can be even totally eliminated, whereby a considerable saving of energy is achieved, for example per a ton of produced paper. According to a preferred embodiment of the invention, the exit side of the runnability component is substantially free of blow nozzles or blow slots, i.e. on the exit side of the runnability component there are no elements or components creating active blows.

According to a preferred embodiment of the invention the auxiliary sealing element is arranged to the exit side part of the lower part of the runnability component, i.e. at a point whose distance from the exit side web run delimiting the pocket space is, in the horizontal direction, 1-50% of the horizontal distance between the entry side and exit side web runs, preferably 1-25%, most preferably 1-20%. The auxiliary sealing element can thus be arranged closer to the exit side web run delimiting the pocket space than to the entry side web run. The advantage of this embodiment is that as large a part as possible of the upper surface of the turning suction roll remains in the first underpressure zone delimited by the auxiliary sealing element, i.e. on the entry side of the auxiliary sealing element in the longitudinal direction of the machine. Thereby, the suction of the turning suction roll can be utilized as efficiently as possible for creating the underpressure of the first underpressure zone. In one preferred embodiment of the invention, the auxiliary sealing element is arranged in the lower surface of the runnability component, on average in the middle of the lower surface of the runnability component. This means that the distance from the connecting point of the auxiliary sealing element and the lower surface of the runnability component to the entry side first edge of the lower surface of the runnability component is on average the same as to the exit side second edge.

According to an embodiment of the invention, the sealing element and/or the auxiliary sealing element in connection with the entry side of the runnability component is divided into parts in the lateral direction of the machine. The sealing element/the auxiliary sealing element is preferably elongated in the cross direction of the paper machine or the like and extends substantially over the entire width of the web run. The sealing element/the auxiliary sealing element can be assembled of several parts. Thereby, its mounting, transportation and storage is easier, as long bracings can be avoided during transports.

According to an embodiment of the invention, a valve, a throttle or other device or means affecting the air flow in the channel is arranged in the channel. Also a device adjusting the air flow and/or pressure can be provided in the channel. Thus, in order to adjust the pressure differences between the first and the second underpressure zones of the pocket space it is possible to use valves or throttles, which can be controlled preferably together with other control means of the paper machine or from the side of the paper machine, from the tending side or from the driving side. The adjustment can be based on adjusting of the pressure and/or of the flow.

During the run, the aim is to maintain in the first underpressure zone an underpressure, which is typically between 50-700 Pa, more preferably 100-500 Pa, and most preferably 150-300 Pa lower than the normal atmospheric pressure level (approximately 1 bar, i.e. $10^5$ Pa). During the run, the aim is to maintain the underpressure in the second underpressure zone typically between 800-5000 Pa, more preferably 1000-3000 Pa and most preferably 1500-2500 Pa, which underpressure levels are lower than the normal atmospheric pressure level.

According to an embodiment of the invention, the channel can be divided into at least two different longitudinal channels, which are next to each other in the lateral direction of the machine. The channel connecting the underpressure zones is then divided into parts in the machine direction, which parts are next to each other in the cross direction of the machine. The runnability component can be divided in a corresponding manner into parts in the machine direction, whereby the runnability component can be provided with at least one, preferably several partition walls in the machine direction. In this manner the pocket space can be divided into several adjacent underpressure sections, which can be controlled independently. This enables optimization of the underpressure conditions so as to be suitable for each running situation. The first and the second underpressure zones of the adjacent underpressure sections can be optimized so that, for example, in the outermost sections a first underpressure prevails in the first underpressure zones, which first underpressure is substantially different, either higher or lower than the underpressure in the first underpressure zones of the middlemost underpressure sections located between the outermost underpressure sections. In a corresponding manner, the underpressures in the second underpressure zones of the outermost and the middlemost underpressure sections can differ from each other.

In case several adjacent underpressure sections are used, it is possible to turn or otherwise adjust separately, independently from each other, the valves, throttles, turn plates or other adjusting means in the channels connecting the first and the second underpressure zones to each other, so that the underpressure in the first underpressure zone separated by the sealing element can be adjusted so as to be different from the second underpressure zone at different locations in the cross machine direction.

According to an embodiment of the invention, the arrangement comprises a divided tail threading zone in the channel between the underpressure zones, the operation of which zone is controlled in a precise manner during and after the tail threading. Thus, for the proportion meant for tail threading of the web run a separate tail threading zone can be arranged in the channel. During the tail threading the air flow and/or pressure of the channel can be controlled into one value and after the tail threading, i.e. in a normal running situation with a wide web run, to a second value. The tail threading zone can be located, with respect to the web run, on the tending side, on the driving side or in the central area of the web run.

During the tail threading, the aim is to maintain the underpressure in the first underpressure zone of the tail threading zone between 0-500 Pa lower than the normal atmospheric pressure level, and in the second underpressure zone between 500-3000 Pa lower than the normal atmospheric pressure level. In other words, the underpressure in the first underpressure zone is about 99.5-101 kPa and in the second underpressure zone about 97-99.5 kPa.

An embodiment of the invention comprises one or several tail threading means, which can be for example different kinds of devices needed for forming, transferring, receiving, guiding and further transferring of the tail end. These devices can also be different kinds of water cutters, means for slating draw, dampers and measuring devices. The tail threading means can be located in the edge area of the web run, either on the tending side or on the driving side. They can also be in the central area of the web run, for example in the center line. For the tail threading sector, it is especially preferable to provide the sealing elements/the auxiliary sealing elements for the possibility for different properties, such as for directing blows or suctions. Appropriate surface roughnesses, coatings can also be incorporated also on the jacket of the turn roll in the tail threading sector or in the tail threading zone, which can be coupled as an extension of the jacket, possibly also as a separate tail threading zone.

According to an embodiment of the invention the above mentioned location of the sealing element is, more precisely described, substantially in connection with the opening nip of the first drying cylinder.

According to a preferred embodiment of the invention, the sealing element is a multi-stepped sealing. The sealing element and/or the auxiliary sealing element can be a labyrinth sealing. It can be formed of, for example, Teflon stripes. The material of the sealing element/auxiliary sealing element can be, for example, Teflon, plastic, rubber, composite or metal, such as steel or aluminium. A requirement for the material is a sufficient rigidity, with which the free flow of air can be prevented. In addition, it is easily repulpable or entirely non-repulpable in order not to induce problems in pulping, in case small pieces are detached from it.

A grooved and perforated suction roll (vac-roll), a grooved and perforated roll, a grooved roll, a perforated roll or a smooth roll can function as a turn roll in the arrangement according to the invention. According to an embodiment of the invention, the arrangement comprises means for creating underpressure inside the turn roll, so that a higher underpressure can be created inside the turn roll than in the first underpressure zone located in the vicinity of the turn roll surface, thereby creating an air flow from the first underpressure zone into the turn roll. In the embodiment the roll is then perforated, possibly also grooved. A sucking flow on the periphery of the turn roll towards the inside of the roll is active in the direction of the first underpressure zone beginning at the moment when the wire and the web run detach from the surface of the roll (exit point) and ending at the moment when the wire and the web run meet the surface of the roll (entry point).

In known solutions, the underpressure inside the turning suction roll has been about 2000-2500 Pa. Due to the arrangement according to the invention, the amount of air needed for creating the underpressure, for example handled by a fan, can be considerably reduced, which has an effect on a substantial energy saving, for example, from the level of 800-1000 $m^3$/hour/meter of web width to the level of 400 $m^3$/hour/meter of web width.

In case the turn roll is a turning suction roll, its underpressure sucks air from the pocket space above the turning suction roll, especially from the first underpressure zone. The turning suction roll is preferably a roll according to prior art, whose jacket is provided with apertures and whose jacket surface can also be provided with grooves. The grooves are preferably fitted to travel via the openings, whereby the advantage is achieved that the suction effect spreads in the groove on the area of the periphery, over a long distance and area, thereby intensifying the adhesion between the paper and the roll, and does not remain merely in the area of the opening, which is a relatively limited area. The grooves and the openings are arranged with respect to the width of the web run so that the grooves and the openings cover substantially the entire web run width.

In an embodiment of the invention, a turn roll, which has no connection with the means creating the underpressure can be used as a turn roll. In case a turning suction roll is not used as a turn roll, then the roll can be chosen more freely, whereby for example a grooved roll, a perforated roll, a grooved and perforated roll or a smooth roll can be used. In case the roll is a turning suction roll, it is preferably grooved and perforated. In case the roll used is not a suction roll, then considerable cost savings are achieved. A perforated roll jacket with its suction connections forms a considerable cost item, especially as the same structure recurs in the drying section and several corresponding rolls are needed.

According to an embodiment of the invention, in the runnability component, on the entry side, an entry side blow nozzle is arranged in connection with the gap between the runnability component and the first drying cylinder in order to blow air substantially against the travelling direction of the web run, away from the pocket space. According to an embodiment of the invention, as the means for creating underpressure in the second underpressure zone is mentioned an entry side blow nozzle, in which the Coanda-effect is utilized in a manner known as such.

In an embodiment of the invention, according to prior art, the underpressure of the pocket space between the drying cylinders and the turn roll can be guided, in addition to the entry side blow nozzle of the runnability component, with an exit side blow nozzle with which air is ejected out of the pocket space and/or the entry of the air into the pocket space via the gap between the exit side of the runnability component and the second drying cylinder is prevented.

BRIEF DESCRIPTION OF THE FIGURES

The invention is described in more detail below with reference to the enclosed schematic drawing, in which.

DETAILED DESCRIPTION OF THE EXAMPLES OF THE FIGURES

Figure 1:
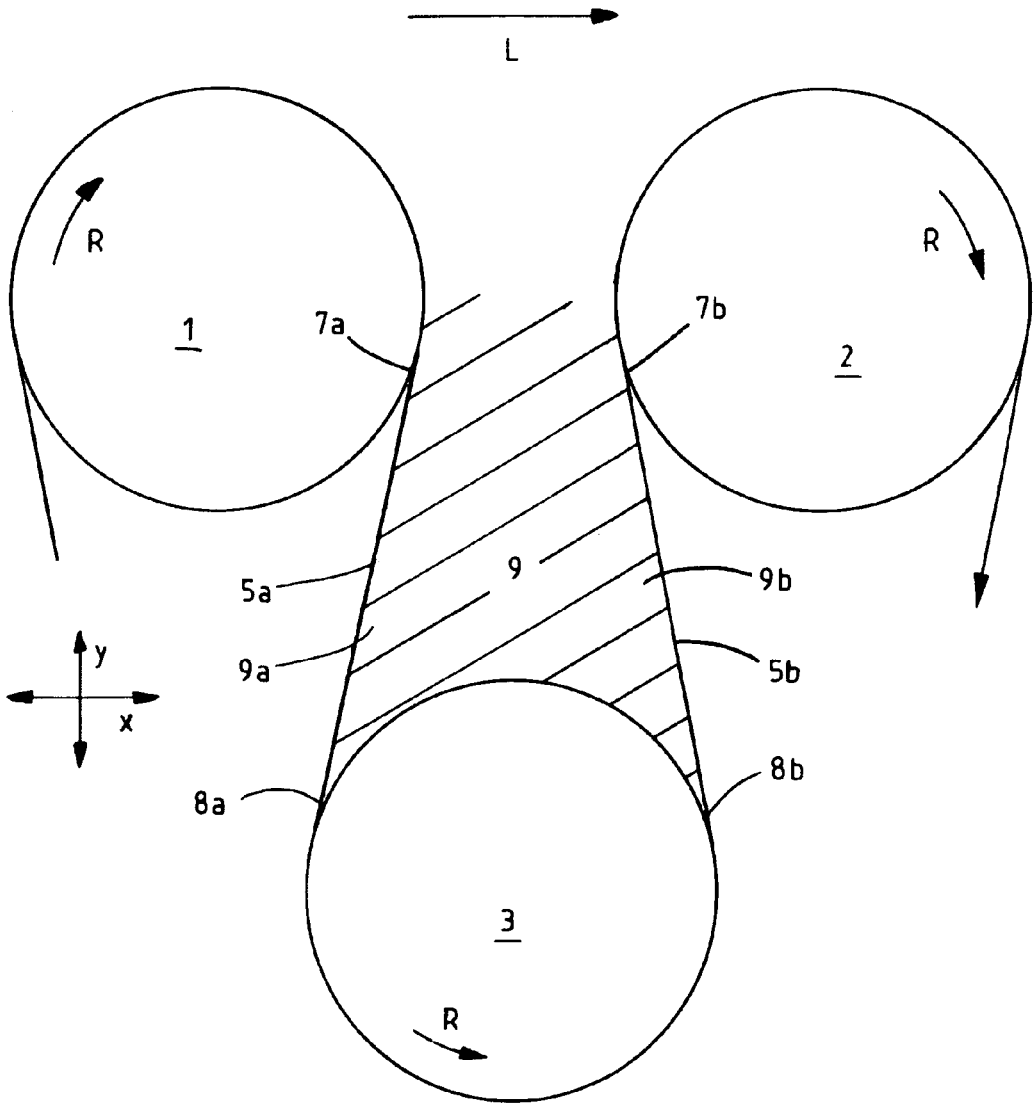
FIG. 1 Prior Art
FIG. 1 shows a pocket space between two drying cylinders and one turn roll.

FIG. 1 shows as a schematic view a pocket space 9 forming part of the arrangement of the invention between two drying cylinders 1, 2 and one turn roll 3 in the drying section of a paper machine. The pocket space 9 is delimited by a first drying cylinder 1, a second drying cylinder 2, a turn roll 3 and a wire 5*a*, 5*b*. Described more in detail, the pocket space 9 is delimited on its entry side 9*a* by a wire run 5*a* between the first drying cylinder 1 and the turn roll 3, and on the exit side 9*b* of the pocket space, by a wire run 5*b* between the turn roll 3 and the second drying cylinder 2. The location of the turn roll in a horizontal direction x and in a longitudinal direction L of the paper machine is between the drying cylinders 1, 2, but in a vertical direction y lower than said cylinders 1, 2. The directions of rotation of the cylinders 1, 2 and of the roll 3 are shown by arrows R. It is to be understood, that the above-presented structure is recurred by its substantial parts being repeated in the drying section of a paper or a board machine. Minor structure-specific exceptions and tailoring can be created by, for example, the tail threading means, which can be, for example, different kinds of means needed for forming, transferring, receiving, guiding and further transferring of the tail end. These means can also be different kinds of water cutters, means for slating draw, dampers and measuring devices.

In this figure and in the others, the web run travels between the drying cylinders and the wire and, respectively, outside the wire on the turn roll.

The figure also shows:

- an opening nip 7*a* of the first drying cylinder 1, i.e. the point where the wire 5*a* detaches from the periphery of the first drying cylinder 1 towards the turn roll 3,
- a closing nip 8*a* of the turn roll, i.e. the point where the wire 5*a* enters into connection with the turn roll 3 after the first drying cylinder 1,
- an opening nip 8*b* of the turn roll 3, i.e. the point where the wire 5*b* detaches from the periphery of the turn roll 3 towards the second drying cylinder 2,
- a closing nip 7*b* of the second drying cylinder 2, i.e. the point where the wire 5*b* enters into connection with the second drying cylinder 2 after the turn roll 3.

Figure 2:
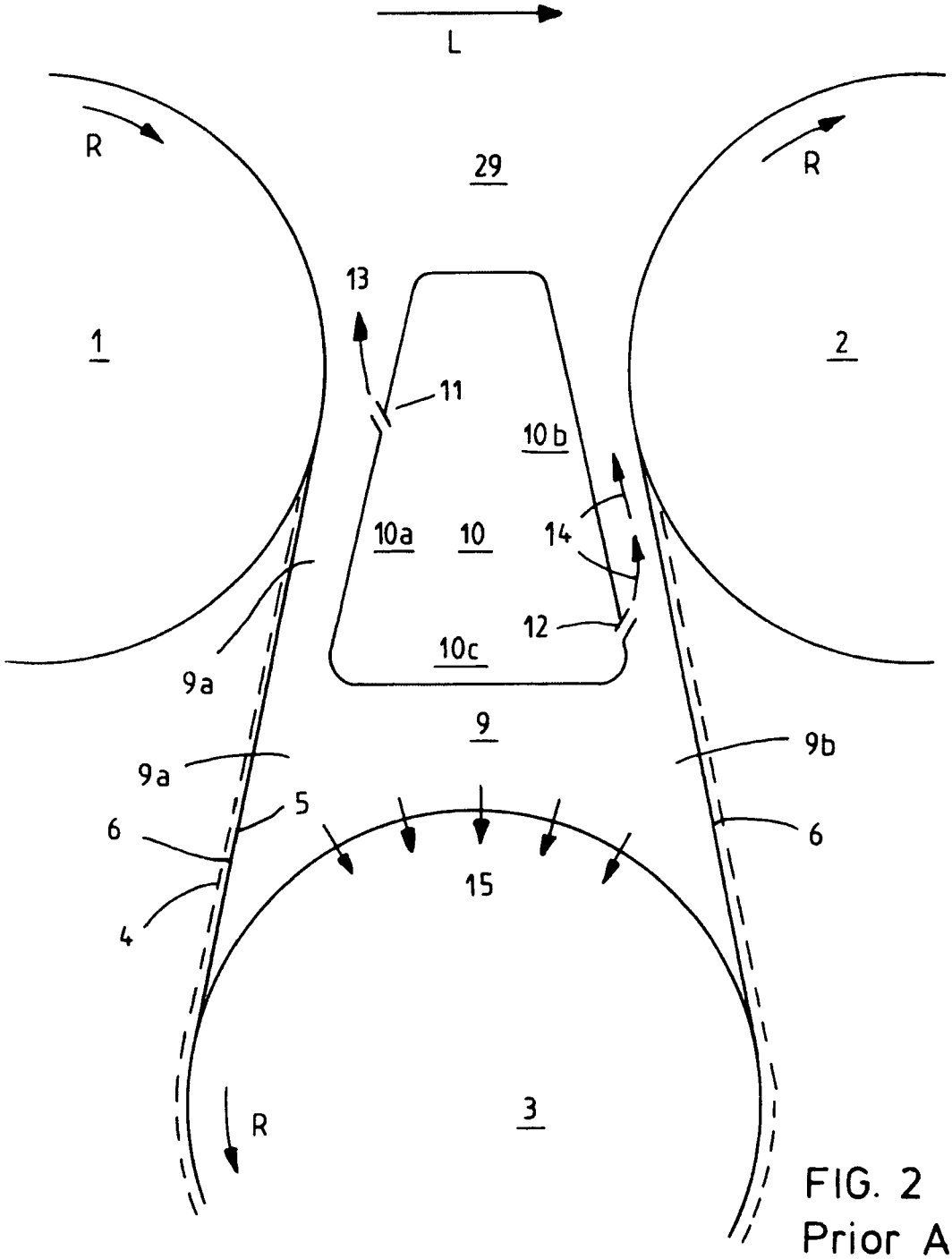
FIG. 2 Prior Art
FIG. 2 shows an arrangement according to prior art in connection with the drying cylinders and the turn roll of a paper machine.

FIG. 2 shows an arrangement according to prior art in connection with the pocket space 9 between the drying cylinders 1, 2 and the turn roll 3 of a paper machine, which arrangement is provided with a box-like runnability component 10, which in this example is a blow box. The blow box is provided with two blow nozzles 11, 12 in order to create an underpressure zone in the pocket space 9. In connection with the entry side 10*a* of the runnability component 10 there is an entry side blow nozzle 11, which on the entry side 9*a* of the pocket space 9 blows air in connection with the gap between the runnability component 10 and the first drying cylinder 1 against the travelling direction of the web run 6 away from the pocket space 9 according to arrow 13, and thereby ejects air away from the pocket space 9 and prevents the air entailed by the web run 6 from entering into the pocket space 9 via the gap between the first drying cylinder 1 and the entry side 10*a* of the runnability component. In addition, the underpressure of the pocket space 9 is controlled by an exit side blow nozzle 12, which blows air on the exit side 9*b* of the pocket space 9 in the travelling direction of the web run 6 according to arrow 14, and thereby ejects air away from the pocket space 9 and prevents the air from entering into the pocket space via the gap between the exit side 10*b* of the runnability component and the second drying cylinder 2. In addition to the blow box 10, the underpressure of the pocket space 9 is created by means of the turn roll 3. The suction of the turn roll 3 is presented by arrows 15, of which suction only a part is presented in the figure.

Figure 3:
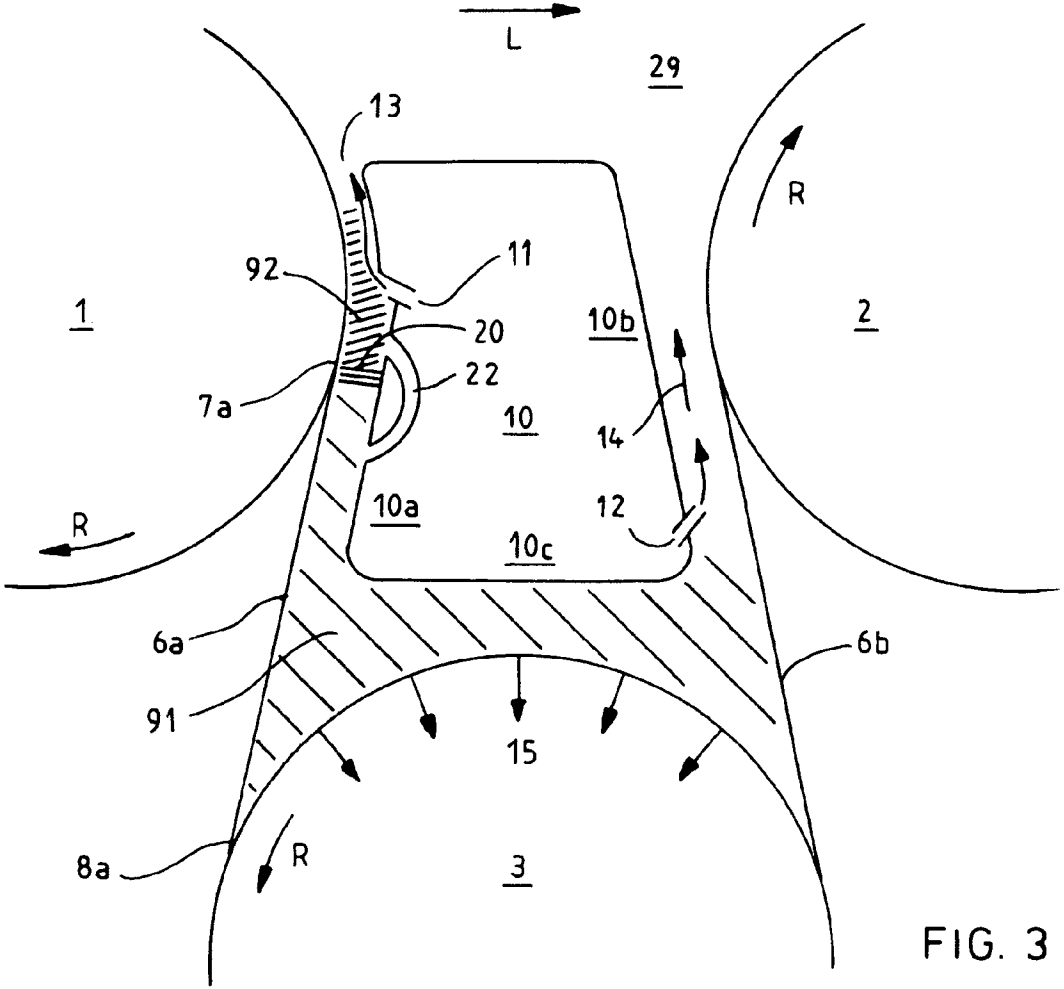
FIG. 3 shows an arrangement according to the invention in connection with two drying cylinders and one turn roll.

FIG. 3 shows an arrangement according to the first embodiment of the invention in connection with two drying cylinders 1, 2 and one turn roll 3 of a paper machine. On the entry side 10*a* of the blow box, a labyrinth sealing 20 is arranged in connection with the opening nip 7*a* between the blow box and the first drying cylinder 1 located before the turn roll 3. A first underpressure zone 91 is created in the pocket space, which first underpressure zone is delimited by a labyrinth sealing 20, the web draw 6*a* between the entry side drying cylinder 1 and the turn roll 3, the upper surface of the turn roll, and by the lower part 10*c* and the entry side 10*a* of the blow box. A second underpressure zone 92, in which the underpressure is usually higher than in the first underpressure zone 91, is formed in the part of the pocket space located above the labyrinth sealing 20 due to an air jet 13 from the blow nozzle 11 on the entry side 10*a* of the blow box. The air jet 13 of the blow nozzle 11 is directed to the entry side of the runnability component, where it is directed outwards preferably by a narrow slit or a row of openings. The flow follows a shaped extension and rises upwards in the direction of the curved surface against the incoming direction of the web run. The second underpressure zone 92 is delimited in its lower part by a labyrinth sealing 20 and in the sideward direction by the first drying cylinder 1 and the entry side 10*a* of the blow box and by the gap plates in the ends of the pocket space. The space outside the pocket space is marked with reference number 29. The labyrinth sealing can be realized also as a multi-stepped sealing.

The first underpressure zone 91 of the arrangement of FIG. 3 is marked with coarse slanting stripes and the second underpressure zone 92 with dense slanting stripes. The runnability component 10, which in this example is a blow box, is provided with a by-pass channel 22 arranged between the first underpressure zone 91 and the second underpressure zone 92, by means of which by-pass channel 22 the underpressures of or the pressure difference between the underpressure zones 91, 92 can be controlled, for example balanced.

Figure 4:
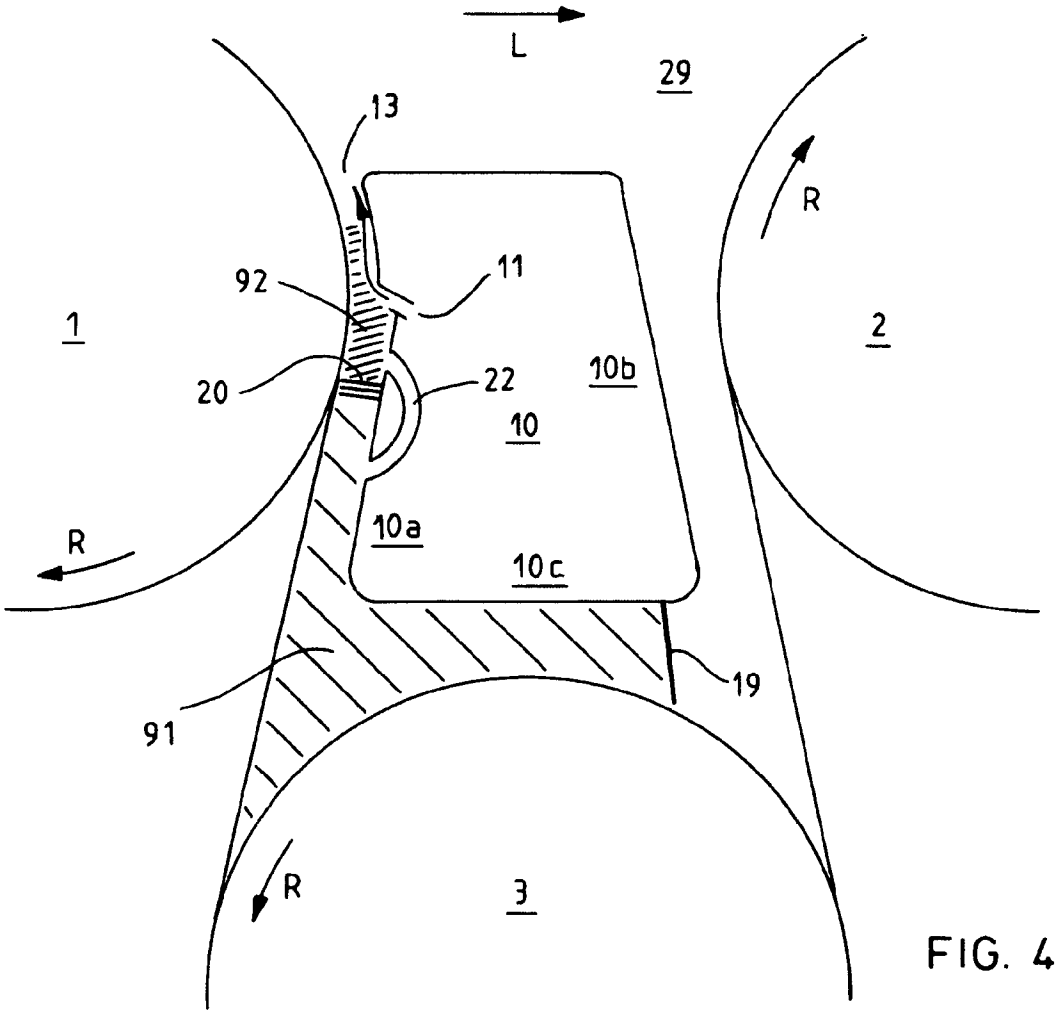
FIG. 4 shows an arrangement according to a combined embodiment of the invention.

FIG. 4 shows an arrangement according to the embodiment of the invention in connection with two drying cylinders 1, 2 and one turn roll 3 of a paper machine. On the entry side 10*a* of the blow box, a labyrinth sealing 20 is arranged in connection with the opening nip 7*a* between the blow box and the first drying cylinder 1 located before the turn roll 3. A first underpressure zone 91 is created in the pocket space, which first underpressure zone is delimited by a labyrinth sealing 20, the free web draw 6*a* between the entry side drying cylinder 1 and the turn roll 3, the upper surface of the turn roll, and by the lower part 10*c* and the entry side 10*a* of the blow box and by the auxiliary sealing element 19. The second underpressure zone 92, in which the underpressure is usually higher than in the first underpressure zone 91, is formed in the part of the pocket space located above the labyrinth sealing 20 due to an air jet 13 from the blow nozzle 11 on the entry side 10*a* of the blow box. The second underpressure zone 92 is delimited in its lower part by a labyrinth sealing 20 and in the sideward direction by the first drying cylinder 1 and the entry side 10*a* of the blow box and by the gap plates in the ends of the pocket space. The space outside the pocket space is marked with reference number 29. The labyrinth sealing can be realized also as a multi-stepped sealing. In this embodiment, the first underpressure zone 91 is delimited with an auxiliary sealing element 19, which, for its part, seals the first underpressure zone against the turn roll. The auxiliary sealing element can be, for example, a sealing strip.

The first underpressure zone 91 of the arrangement of FIG. 4 is marked with coarse slanting stripes and the second underpressure zone 92 with dense slanting stripes. The runnability component 10, which in this example is a blow box, is provided with a by-pass channel 22 arranged between the first underpressure zone 91 and the second underpressure zone 92, by means of which by-pass channel 22 the underpressures of or the pressure difference between the underpressure zones 91, 92 can be controlled, for example balanced.

The invention is not meant to be limited to the embodiments shown as examples above, but the aim is to interpret it extensively within the scope of protection defined in the claims presented below.

What is claimed is:

1. A runnability component comprising:

an entry side;

an exit side;

an intermediate side between the entry side and the exit side; and a sealing element on an outer surface of the entry side dividing the outer surface of the entry side into a first part and a second part, the entry side having a channel extending from the first part to the second part.

2. The runnability component of claim 1, further comprising a means for affecting air flow through the channel.

3. The runnability component of claim 2, wherein the means for affecting air flow is one of a valve and a throttle.

4. The runnability component of claim 2, further comprising an auxiliary sealing element on an outer surface of the intermediate side.

5. The runnability component of claim 2, further comprising a tail threading zone in the channel comprising auxiliary sealing elements.

6. The runnability component of claim 1, further comprising an auxiliary sealing element on an outer surface of the intermediate side.

7. A runnability component for a drying section of a paper machine, the machine having a pocket space between two drying cylinders and one turn roll, the pocket space being formed by a first drying cylinder, a second drying cylinder located after the first drying cylinder in the longitudinal direction of the machine, a turn roll located between, and offset from, the first and second drying cylinders, and a wire supporting a web and travelling from the first drying cylinder to the turn roll and from the turn roll to the second drying cylinder, a first web run being formed between the first drying cylinder and the turn roll and a second web run being formed between the turn roll and the second drying cylinder, with the web running on an outer surface of the wire relative to the pocket space and on the periphery of the turn roll, the runnability component comprising:

a box-shaped component elongated in the cross-direction of the paper machine and extending substantially over an entire width of the first and second web runs and positionable in the pocket space, the box-shaped component having an entry side, an exit side, and an intermediate side between the entry side and the exit side; and a sealing element on an outer surface of the entry side dividing the outer surface of the entry side into a first part and a second part, the entry side having a channel extending from the first part to the second part.

8. The runnability component of claim 7, further comprising an entry side blow nozzle positioned to blow air substantially against the travel direction of the web and away from the pocket space in a gap between the box-shaped component and the first drying cylinder.

9. The runnability component of claim 8, wherein the channel is elongated in the cross direction and extends substantially across the entire width of the first web run.

10. The runnability component of claim 8, wherein the channel comprises more than one channel disposed next to one another in a lateral direction of the machine.

11. The runnability component of claim 7, wherein the channel is elongated in the cross direction and extends substantially across the entire width of the first web run.

12. The runnability component of claim 7, wherein the channel comprises more than one channel disposed next to one another in a lateral direction of the machine.

13. The runnability component of claim 7, further comprising a means for affecting air flow through the channel.

14. The runnability component of claim 13, wherein the means for affecting air flow is one of a valve and a throttle.

15. The runnability component of claim 7, wherein the sealing element is a multi-stepped sealing.

16. A drying section of paper machine comprising the runnability component of claim 7 positioned in the pocket space formed by a first drying cylinder, a second drying cylinder located after the first drying cylinder in the longitudinal direction of the machine, a turn roll located between, and offset from, the first and second drying cylinders, and a wire supporting a web and travelling from the first drying cylinder to the turn roll and from the turn roll to the second drying cylinder.

17. The drying section of claim 16, further comprising means for creating an underpressure inside the turn roll so that a higher underpressure can be created inside the turn roll than in an underpressure zone, the underpressure zone being defined by the sealing element, the entry side of the box-shaped component, the intermediate side of the box-shaped component, the turn roll, and the wire, a difference in underpressure between the turn roll and the underpressure zone being sufficient to thereby provide an air flow from the underpressure zone into the turn roll.

18. The drying section of claim 16, further comprising an auxiliary sealing element on an outer surface of the intermediate side.

19. The drying section of claim 16, further comprising at least one tail threading means.

20. The drying section of claim 19, wherein the at least one tail threading means is located in an edge area of the first web run or in a central area of the first web run.

21. A method for saving energy in a drying section of a paper machine, the machine having a pocket space between two drying cylinders and one turn roll, the pocket space being formed by a first drying cylinder, a second drying cylinder located after the first drying cylinder in the longitudinal direction of the machine, a turn roll located between, and offset from, the first and second drying cylinders, and a wire supporting a web and travelling from the first drying cylinder to the turn roll and from the turn roll to the second drying cylinder, a first web run being formed between the first drying cylinder and the turn roll and a second web run being formed between the turn roll and the second drying cylinder, with the web running on an outer surface of the wire relative to the pocket space and on the periphery of the turn roll, the method comprising:

sealing off the pocket space with a box-shaped component elongated in the cross-direction of the paper machine and extending substantially over the entire width of the first and second web runs and positioned in the pocket space, the box-shaped component having an entry side, an exit side, and an intermediate side between the entry side and the exit side, the entry side having an entry side blow nozzle positioned to blow air substantially against the travel direction of the web and away from the pocket space in a gap between the box-shaped component and the first drying cylinder;

sealing off a gap between the box-shaped component and the first drying cylinder with a sealing element on an outer surface of the entry side dividing the outer surface of the entry side into a first part and a second part, the entry side having a channel extending from the first part to the second part; and creating an underpressure in a first underpressure zone defined by the sealing element, the first part of the outer surface of the entry side of the box-shaped component, the intermediate side of the box-shaped component, the exit side of the box-shaped component, the turn roll and the wire;

creating an underpressure in a second underpressure zone in the pocket space defined by the sealing element, the second part of the outer surface of the entry side of the box-shaped component, and the wire;

controlling a pressure difference between the first and second underpressure zones by means of the channel.

22. The method of claim 21, wherein a pressure difference between the first and second underpressure zones is different during and after tail threading of a web through the drying section.

* * * * *